US007975763B2

(12) United States Patent
Banerjee et al.

(10) Patent No.: US 7,975,763 B2
(45) Date of Patent: Jul. 12, 2011

(54) PROCESS FOR ENHANCED PRODUCTION OF HEAVY OIL USING MICROWAVES

(75) Inventors: Dwijen K. Banerjee, Ponca City, OK (US); John L. Stalder, Calgary (CA)

(73) Assignee: ConocoPhillips Company, Houston, TX (US)

( * ) Notice: Subject to any disclaimer, the term of this patent is extended or adjusted under 35 U.S.C. 154(b) by 125 days.

(21) Appl. No.: 12/239,051

(22) Filed: Sep. 26, 2008

(65) Prior Publication Data

US 2010/0078163 A1 Apr. 1, 2010

(51) Int. Cl.
*E21B 43/24* (2006.01)

(52) U.S. Cl. ..... 166/248; 166/65.1; 166/272.1; 166/272.3; 166/272.6; 166/272.7; 166/302

(58) Field of Classification Search ..... 166/248, 166/60, 65.1, 249, 272.1, 272.3, 272.6, 272.7, 166/302
See application file for complete search history.

(56) References Cited

U.S. PATENT DOCUMENTS

| | | | | |
|---|---|---|---|---|
| 4,094,798 | A * | 6/1978 | Tate et al. | 507/238 |
| RE30,738 | E * | 9/1981 | Bridges et al. | 166/248 |
| 4,457,365 | A * | 7/1984 | Kasevich et al. | 166/60 |
| 4,485,868 | A | 12/1984 | Sresty et al. | |
| 4,620,593 | A * | 11/1986 | Haagensen | 166/248 |
| 4,638,863 | A * | 1/1987 | Wilson | 166/248 |
| 4,700,716 | A * | 10/1987 | Kasevich et al. | 607/156 |
| 4,817,711 | A * | 4/1989 | Jeambey | 166/248 |
| 4,912,971 | A | 4/1990 | Jeambey | |
| 5,082,054 | A | 1/1992 | Kiamanesh | |
| 5,109,927 | A * | 5/1992 | Supernaw et al. | 166/248 |
| 5,321,222 | A | 6/1994 | Bible et al. | |
| 5,521,360 | A | 5/1996 | Johnson et al. | |
| 5,899,274 | A | 5/1999 | Frauenfeld et al. | |
| 6,012,520 | A * | 1/2000 | Yu et al. | 166/245 |
| 6,544,411 | B2 | 4/2003 | Varadaraj | |
| 6,814,141 | B2 | 11/2004 | Huh et al. | |
| 7,073,577 | B2 | 7/2006 | Yu | |
| 7,091,460 | B2 | 8/2006 | Kinzer | |
| 7,461,693 | B2 * | 12/2008 | Considine et al. | 166/248 |
| 7,484,561 | B2 * | 2/2009 | Bridges | 166/248 |
| 7,677,673 | B2 * | 3/2010 | Tranquilla et al. | 299/2 |
| 2005/0199386 | A1 * | 9/2005 | Kinzer | 166/248 |
| 2007/0131591 | A1 | 6/2007 | Pringle | |
| 2007/0289736 | A1 | 12/2007 | Kearl et al. | |
| 2008/0073079 | A1 * | 3/2008 | Tranquilla et al. | 166/270.1 |
| 2009/0071648 | A1 * | 3/2009 | Hagen et al. | 166/272.1 |
| 2009/0139716 | A1 * | 6/2009 | Brock et al. | 166/272.1 |

FOREIGN PATENT DOCUMENTS

| | | |
|---|---|---|
| GB | 0896407 | 5/1962 |
| JP | 5112004104 | 10/1976 |
| WO | 2007/081493 A2 | 7/2007 |

OTHER PUBLICATIONS

Deutsch, C.V. and McLennan, J.A., Guide to SAGD (Steam Assisted Gravity Drainage) Reservoir Characterization Using Geostatistics, 2005, Centre for Computational Geostatistics.

* cited by examiner

*Primary Examiner* — George Suchfield

(57) ABSTRACT

A process for utilizing microwaves to heat $H_2O$ within a subterranean region wherein the heated $H_2O$ contacts heavy oil in the subterranean region to lower the viscosity of the heavy oil and improve production of the heavy oil.

18 Claims, 2 Drawing Sheets

PROCESS FOR ENHANCED PRODUCTION OF HEAVY OIL USING MICROWAVES

FIELD OF THE INVENTION

The present invention relates generally to a process for recovering heavy oil from a reservoir. In particular, the invention provides for utilizing microwaves to heat $H_2O$ which interacts with the heavy oil in the reservoir to lower the viscosity of the heavy oil.

DISCUSSION OF THE PRIOR ART

Heavy oil is naturally formed oil with very high viscosity but often contains impurities such as sulfur. While conventional light oil has viscosities ranging from about 0.5 centipoise (cP) to about 100 cP, heavy oil has a viscosity that ranges from 100 cP to over 1,000,000 cP. Heavy oil reserves are estimated to equal about fifteen percent of the total remaining oil resources in the world. In the United States alone, heavy oil resources are estimated at about 30.5 billion barrels and heavy oil production accounts for a substantial portion of domestic oil production. For example, in California alone, heavy oil production accounts for over sixty percent of the states total oil production. With reserves of conventional light oil becoming more difficult to find, improved methods of heavy oil extractions have become more important. Unfortunately, heavy oil is typically expensive to extract and recovery is much slower and less complete than for lighter oil reserves. Therefore, there is a compelling need to develop a more efficient and effective means for extracting heavy oil.

Viscous oil that is too deep to be mined from the surface may be heated with hot fluids or steam to reduce the viscosity sufficiently for recovery by production wells. One thermal method, known as steam assisted gravity drainage (SAGD), provides for steam injection and oil production to be carried out through separate wellbores. The optimal configuration is an injector well which is substantially parallel to and situated above a producer well, which lies horizontally near the bottom of the formation. Thermal communication between the two wells is established and, as oil is mobilized and produced, a steam chamber or chest develops. Oil at the surface of the enlarging chest is constantly mobilized by contact with steam and drains under the influence of gravity.

There are several patents on the improvements to SAGD operation. U.S. Pat. No. 6,814,141 describes applying vibrational energy in a well fracture to improve SAGD operation. U.S. Pat. No. 5,899,274 teaches addition of solvents to improve oil recovery. U.S. Pat. No. 6,544,411 describes decreasing the viscosity of crude oil using ultrasonic source. U.S. Pat. No. 7,091,460 claims in situ, dielectric heating using variable radio frequency waves.

In a recent patent publication (U.S. Patent Publication 20070289736/US-A1, filed May 25, 2007), it is disclosed to extract hydrocarbons from a target formation, such as a petroleum reservoir, heavy oil, and tar sands by utilizing microwave energy to fracture the containment rock and for liquification or vitalization of the hydrocarbons.

In another recent patent publication (US Patent Publication 20070131591/US-A1, filed Dec. 14, 2006), it is disclosed that lighter hydrocarbons can be produced from heavier carbon-base materials by subjecting the heavier materials to microwave radiations in the range of about 4 GHz to about 18 GHz. This publication also discloses extracting hydrocarbons from a reservoir where a probe capable of generating microwaves is inserted into the oil wells and the microwaves are used to crack the hydrocarbons with the cracked hydrocarbon thus produced being recovered at the surface.

Despite these disclosures, it is unlikely that direct microwave cracking or heating of hydrocarbons would be practical or efficient. It is known that microwave energy is absorbed by a polar molecule with a dipole moment and bypasses the molecules that lack dipole moment. The absorption of the microwave energy by the polar molecule causes excitation of the polar molecule thereby transforming the microwave energy into heat energy (known as the coupling effect). Accordingly, when a molecule with a dipole moment is exposed to microwave energy it gets selectively heated in the presence of non-polar molecules. Generally, heavy oils comprise non-polar hydrocarbon molecules; accordingly, hydrocarbons would not get excited in the presence of microwaves.

Additionally, while the patent publication above claims to break the hydrocarbon molecules, the energy of microwave photons is very low relative to the energy required to cleave a hydrocarbon molecule. Thus, when hydrocarbons are exposed to microwave energy, it will not affect the structure of a hydrocarbon molecule. (See, for example, "Microwave Synthesis", CEM Publication, 2002 by Brittany Hayes).

SUMMARY OF THE INVENTION

Responsive to these and other problems, an object of the present invention is to provide a more efficient and effective method of extracting heavy oil.

A further object of the present invention is to provide a process which provides an improved means of heating a subterranean oil reservoir so that heavy oil can be extracted.

It should be noted that not all of the above listed objects need to be accomplished by the invention claimed herein and other objects and advantages of this invention will be apparent from the following description of the invention and the appended claims.

In accordance with one embodiment of the invention, there is provided a process for heating a subterranean region. The process includes injecting $H_2O$ into the subterranean region through a first wellbore; introducing microwaves into the reservoir at a frequency sufficient to excite the $H_2O$ molecules and increase the temperature of at least a portion of the $H_2O$ within the region; heating at least a portion of the heavy oil into the region by interaction with the heated $H_2O$ to produce heated heavy oil; and producing the heated heavy oil through a second wellbore.

In accordance with another embodiment of the invention there is provided a process as described above, wherein the $H_2O$ is injected as steam and at least a portion of the steam condense as a result of its interaction with the heavy oil and at least a portion of the resulting water is heated by microwaves to form steam.

In accordance with a further embodiment of the invention a process is provided in which at least a portion of the $H_2O$ is injected as water and wherein the microwaves excite the molecules of at least a portion of the water so that the water is heated and becomes steam.

BRIEF DESCRIPTION OF THE DRAWING FIGURES

The advantages and further aspects of the disclosure will be readily appreciated by those of ordinary skill in the art as the same becomes better understood by reference to the following detailed description when considered in conjunction with the accompanying drawings in which like reference characters designate like or similar elements throughout the figures of the drawing and wherein.

DETAILED DESCRIPTION OF THE PREFERRED EMBODIMENTS

In this description, the term water is used to refer to $H_2O$ in a liquid state and the term steam is used to refer to $H_2O$ in a gaseous state.

Figure 1:
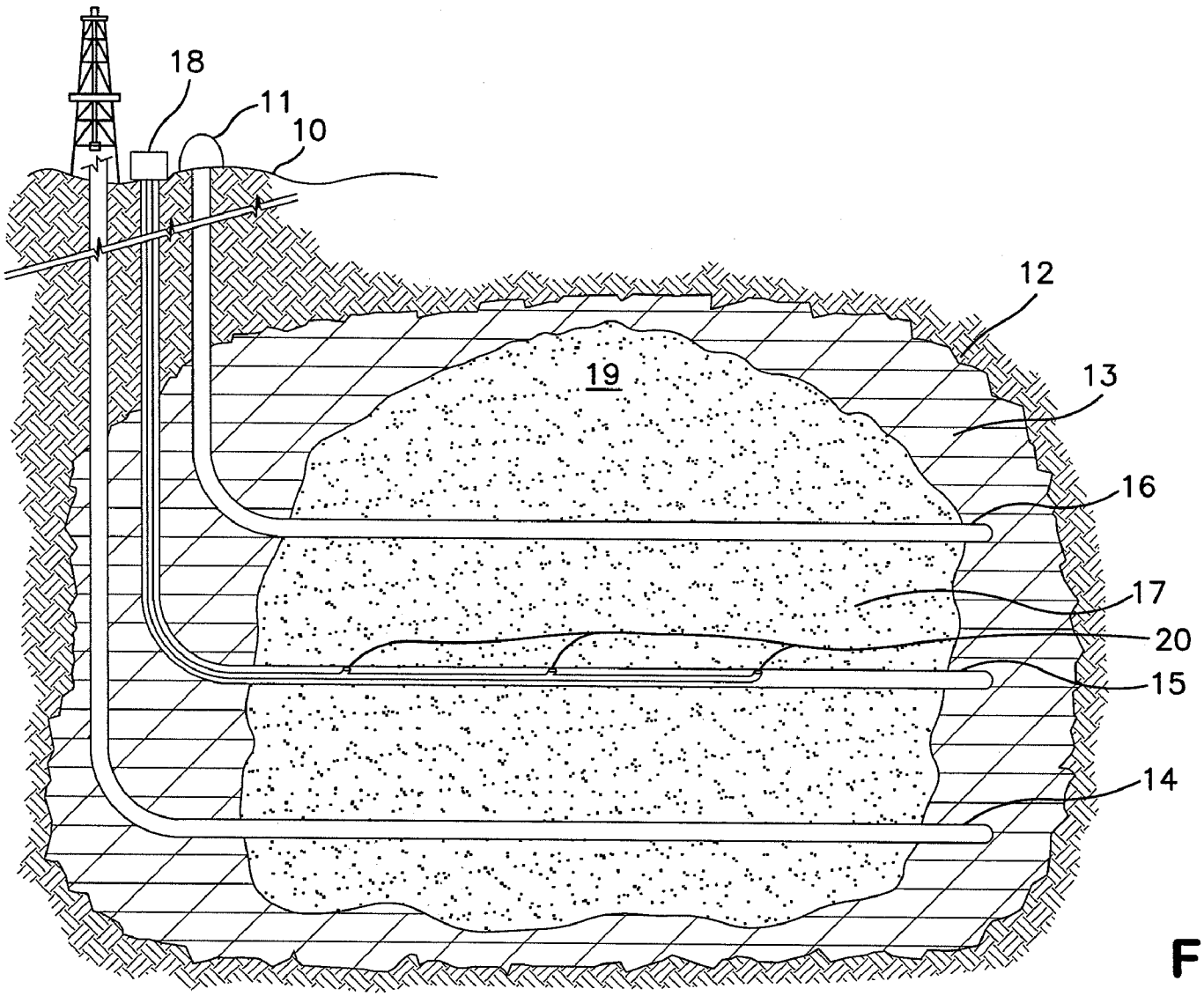
FIG. 1 is a schematic diagram illustrating a heavy oil heating process according to one embodiment of the present invention, wherein wave guides are used to introduce the microwaves to the reservoir.

Turning now to FIG. 1, wellbores 14, 15 and 16 are illustrated. Wellbore 14 extends from the surface 10 into a lower portion of subterranean region 12. Wellbore 16 extends from the surface 10 into subterranean region 12 and generally will be higher than wellbore 14. Wellbore 16 will be used to inject $H_2O$ and it is preferred that it is located higher than wellbore 14 so that when the injected $H_2O$ heats the heavy oil, the heavy oil will flow generally towards wellbore 14, which is used to extract the heavy oil from the reservoir. Wellbore 15 is used to introduce microwaves to the reservoir and it is preferred that wellbore 15 be located intermittent to wellbores 14 and 15; although, other arrangements are possible.

In operation, steam generated in boiler 11 is provided into the reservoir 12 through upper wellbore leg 16. The steam heats the heavy oil within zone 17 of the oil-bearing portion 13 of reservoir 12 causing it to become less viscous and, hence, increase its mobility. The heated heavy oil flows downward by gravity and is produced through wellbore leg 14. While FIG. 1 illustrates a single wellbore for injection and a single wellbore for extraction, other configurations are within the scope of the invention, for example, there can be two or more separate wellbores to provide steam injection and two or more separate wellbores for production. Similarly, multiple wellbores can be used for microwave introduction to the reservoir, as further discussed below.

Generally, the wellbore for steam injection, wellbore 16, will be substantially parallel to and situated above the wellbore for production, wellbore 14, which is located horizontally near the bottom of the formation. Pairs of steam injection wellbores and production wellbores will generally be close together and located at a suitable distance to create an effective steam chamber and yet minimizing the preheating time. Typically, the pairs of injection and production wellbores will be from about 3 meters to 7 meters apart and preferably there will be about 5 meters of vertical separation between the injector and producer wellbores. In this type of SAGD operation, the zone 17 is preheated by steam circulation until the reservoir temperature between the injector and producer wellbore is at a temperature sufficient to drop the viscosity of the heavy oil so that it has sufficient mobility to flow to and be extracted through wellbore 14. Generally, the heavy oil will need to be heated sufficiently to reduce its viscosity to below 3000 cP; however, lower viscosities are better for oil extraction and, thus, it is preferable that the viscosity be below 1500 cP and more preferably below 1000 cP. Preheating zone 17 involves circulating steam inside a liner using a tubing string to the toe of the wellbore. Both the injector and producer would be so equipped. Steam circulation through wellbores 14 and 16 will occur over a period of time, typically about 3 months. During the steam circulation, heat is conducted through the liner wall into the reservoir near the liner. At some point before the circulation period ends, the temperature midway between the injector and producer will reach about 80 to 100° C. and the bitumen will become movable (3000 cP or less). Once this occurs, the steam circulation rate for wellbore 14 will be gradually reduced while the steam rate for the injector wellbore 16 will be maintained or increased. This imposes a pressure gradient from high, for the area around wellbore 16, to low, for the area around wellbore 14. With the oil viscosity low enough to move and the imposed pressure differential between the injection and production wellbores, steam (usually condensed to hot water) starts to flow from the injector into the producer. As the steam rate is continued to be adjusted downward in wellbore 14 and upward in wellbore 16, the system arrives at steam assisted gravity drainage operation with no steam injection through wellbore 14 and all the steam injection through wellbore 16. Once hydraulic communication is established between the pair of injector and producer wellbores, steam injection in the upper well and liquid production from the lower well can proceed. Due to gravity effects, the steam vapor tends to rise and develop a steam chamber at the top section 19 of zone 17. The process is operated so that the liquid/vapor interface is maintained between the injector and producer wellbores to form a steam trap which prevents live steam from being produced through the lower wellbore.

During operation, steam will come into contact with the heavy oil in zone 17 and, thus, heat the heavy oil and increase its mobility by lessening its viscosity. Heated heavy oil will tend to flow downward by gravity and collect around wellbore 14. Heated heavy oil is produced through wellbore 14 as it collects. Steam contacting the heavy oil will lose heat and tend to condense into water. The water will also tend to flow downward toward wellbore 14. In past SAGD operations, this water would also be produced through wellbore 14. Such produced water would need to be treated to reduce impurities before being reheated in the boiler for subsequent injection. As the process continues operation, zone 17 will expand with heavy oil production occurring from a larger portion of oil-bearing portion 13 of subterranean formation 12.

Turning again to FIG. 1, the current invention provides for microwave generator 18 to generate microwaves which are directed underground and into zone 17 of the reservoir through a series of wave guides 20. The diameter of the wave guides will preferably be more than 3 inches in order to ensure good transmission of the microwaves. Within the reservoir, the microwaves will be at a frequency substantially equivalent to the resonant frequency of the water within the reservoir so that the microwaves excite the water molecules causing them to heat up. Optimally, the microwaves will be introduced at or near the liquid vapor interface so that condensed steam is reheated from its water state back into steam further supplying the steam chamber. Generally, the microwave frequency will be not greater than 3000 megahertz and at a resonant frequency of water. Based on the resonant frequency of water, the optimum frequency will be 2450 megahertz; however, power requirements and other factors may dictate that another frequency is more economical. Additionally, salt and other impurities may enhance the coupling effect (production of heat by resonance of a polar or conductive molecule with microwave energy); thus, the presence of salt is desirable.

Figure 2:
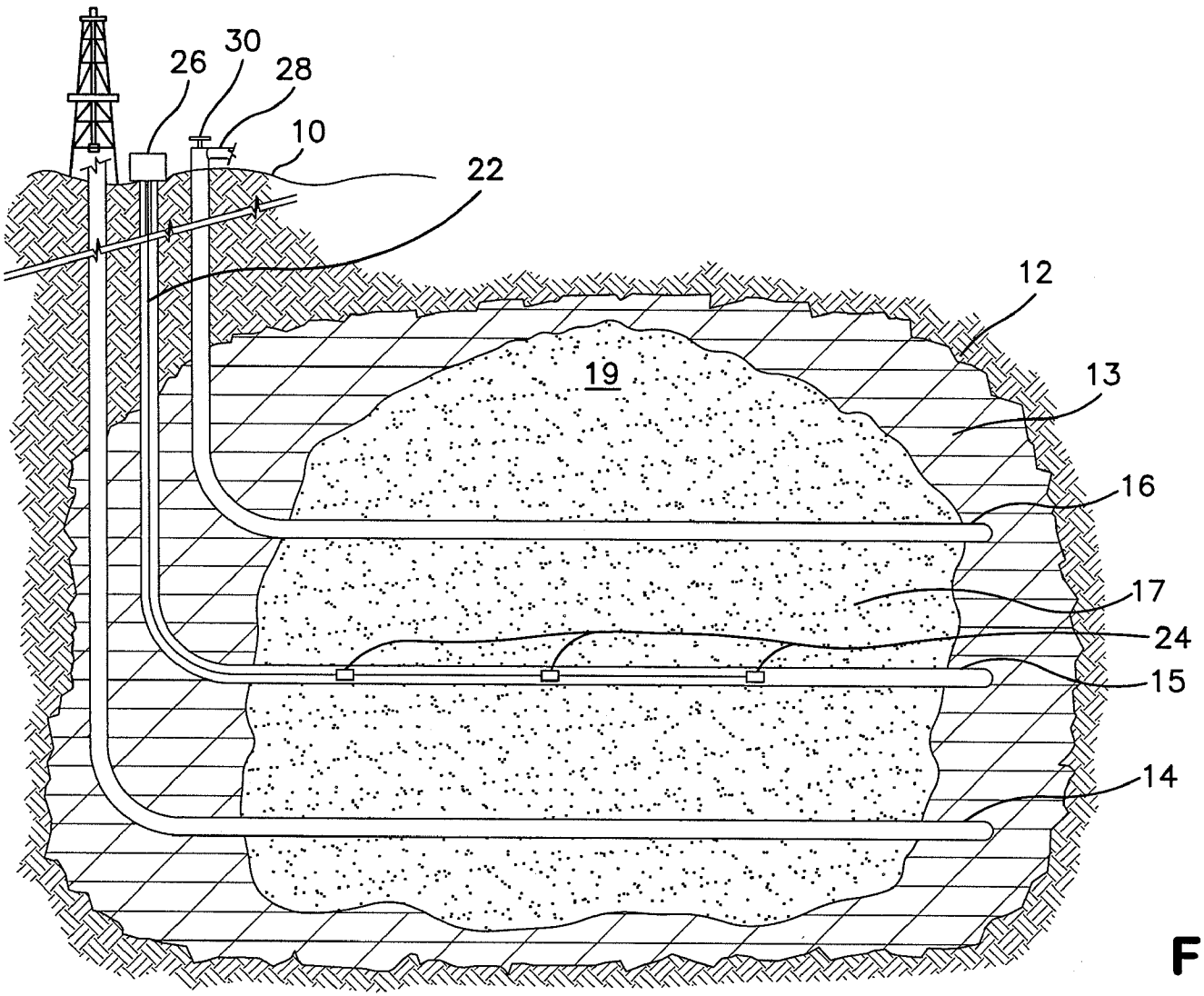
FIG. 2 is a schematic diagram illustrating a heavy oil heating process according to another embodiment of the present invention wherein the microwaves are introduced into the reservoir using a microwave generator located within the reservoir.

Turning now to FIG. 2, a further embodiment of the invention is illustrated wherein, instead of using wave guides, power is supplied through electrical wire 22 to microwave generating probe 24. The electrical power can be supplied to wire 22 by any standard means such as generator 26.

In still another embodiment of the invention, also illustrated in FIG. 2, no steam boiler is used. Instead water is introduced directly into wellbore 16 through pipe 28 and valve 30. Wellbore 16 then introduces water into the reservoir instead of steam and the entire steam production would be accomplished through use of the microwave generators. This embodiment of the invention has the added advantage of avoiding costly water treatment that is necessary when using a boiler to generate steam because, as discussed above, salt and other impurities can aid in heat generation. In a preferred embodiment, the water introduced into the reservoir would have a salt content greater than the natural salt content of the reservoir, which is typically about 5,000 to 7,000 ppm. Accordingly, it is preferred that the introduced water has a salt content greater than 10,000 ppm. For enhanced heat generation 30,000 to 50,000 ppm is more preferred.

Microwave generators useful in the invention would be ones suitable for generating microwaves in the desired frequency ranges recited above. Microwave generators and wave guide systems adaptable to the invention are sold by Cober Muegge LLC, Richardson Electronics and CPI International Inc.

Steam to oil ratio is an important factor in SAGD operations and typically the amount of water required will be 2 to 3 times the oil production. Higher steam to oil production ratios require higher water and natural gas costs. The present invention reduces water and natural gas requirements and reduces some of the water handling involving recycling, cooling, and cleaning up the water.

The preferred forms of the invention described above are to be used as illustration only, and should not be used in a limiting sense to interpret the scope of the present invention. Various modifications to the preferred embodiments set forth above can be readily made by those skilled in the art without departing from the spirit of the present invention.

The inventors hereby state their intent to rely the doctrine of equivalents to determine and access their reasonably fair scope of the present invention as pertains to any process not materially departing from or outside the literal scope of the invention as set forth in the following claims.

That which is claimed:

1. A process comprising:

(a) injecting $H_2O$ into a subterranean region through a first wellbore of a steam assisted gravity drainage operation;

(b) introducing microwaves into the region at a frequency sufficient to excite the $H_2O$ molecules and increase the temperature of at least a portion of the $H_2O$ within the region to produce heated $H_2O$ (c) heating at least a portion of the heavy oil in the region by contact with the heated $H_2O$ to produce heated heavy oil; and (d) producing the heated heavy oil through a second wellbore of the steam assisted gravity drainage operation;

thereby recovering heavy oil with the steam assisted gravity drainage operation from the subterranean region;

wherein the $H_2O$ is injected as steam and the steam contacts with at least a portion of the heavy oil in the region so as to heat the portion of the heavy oil and reduce its viscosity so that it flows generally towards the second wellbore.

2. The process of claim 1 wherein at least a portion of the steam condenses to a liquid state to form water as a result of its contact with the heavy oil and wherein the microwaves excite the molecules of at least a portion of the water so that the water is heated and becomes steam.

3. The process of claim 2 wherein the microwaves are generated at the surface and introduced into the region through at least one waveguide.

4. The process of claim 3, wherein the microwaves have a frequency which is less than or equal to 3000 MHz.

5. The process of claim 2 wherein the microwaves are generated within the region.

6. The process of claim 5 wherein the microwaves have a frequency which is less than or equal to 3000 MHz.

7. The process of claim 1 further comprising injecting at least a portion of the $H_2O$ as water and wherein the microwaves excite the molecules of at least a portion of the thus injected water so that the water is heated and becomes steam.

8. The process of claim 7 wherein the thus injected water has a salt content of at least 10,000 ppm.

9. The process of claim 7 wherein the steam contacts at least a portion of the heavy oil in the region so as to heat the heavy oil and reduce its viscosity so that it flows generally towards the second wellbore.

10. The process of claim 7 wherein at least a portion of the steam condenses to a liquid state to form water as a result of its contact with the heavy oil and wherein the microwaves excite the molecules of at least a portion of the thus formed water so that the water is heated and becomes steam.

11. The process of claim 10 further comprising injecting all the $H_2O$ as water in step (a).

12. The process of claim 11 wherein the thus injected water has a salt content of at least 10,000 ppm.

13. The process of claim 11 wherein the microwaves are generated at the surface and introduced into the region through at least one waveguide.

14. The process of claim 13, wherein the microwaves have a frequency which is less than or equal to 3000 MHz.

15. The process of claim 11 wherein the microwaves are generated within the region.

16. The process of claim 15 wherein the microwaves have a frequency which is less than or equal to 3000 MHz.

17. A process comprising:

(a) injecting liquid $H_2O$ into the region through a first wellbore of a steam assisted gravity drainage operation;

(b) introducing microwaves into a subterranean region at a frequency sufficient to excite the liquid $H_2O$ molecules and increase the temperature of at least a portion of the liquid $H_2O$ within the region to produce heated gaseous $H_2O$ (c) heating at least a portion of the heavy oil in the region by contact with the heated gaseous $H_2O$ to produce heated heavy oil; and (d) producing the heated heavy oil through a second wellbore of the steam assisted gravity drainage operation;

thereby recovering heavy oil with the steam assisted gravity drainage operation from the subterranean region;

wherein a portion of the liquid $H_2O$ is injected as steam and the steam contacts with at least a portion of the heavy oil in the region so as to heat the portion of the heavy oil and reduce its viscosity so that it flows generally towards the second wellbore.

18. A process comprising:

(a) injecting $H_2O$ into a subterranean region through an injection wellbore of a steam assisted gravity drainage operation;

(b) introducing microwaves into the region at a frequency sufficient to excite the $H_2O$ molecules and increase the temperature of at least a portion of the $H_2O$ within the region to produce heated $H_2O$ (c) heating at least a portion of the bitumen to below 3000 cp in the region by contact with the heated $H_2O$ to produce a heated heavy oil and a imposed pressure differential between the injection wellbore and a production wellbore; and (d) producing the heated heavy oil through the production wellbore of the steam assisted gravity drainage operation;

thereby recovering heavy oil with the steam assisted gravity drainage operation from the subterranean region wherein the injection wellbore and the production wellbore are from 3 meters to 7 meters apart and the injection wellbore is located higher than the production wellbore;

wherein the $H_2O$ is injected as steam and the steam contacts with at least a portion of the heavy oil in the region so as to heat the portion of the heavy oil and reduce its viscosity so that it flows generally towards the second wellbore.

* * * * *